United States Patent [19]

Metcalf

[11] Patent Number: 4,930,312

[45] Date of Patent: Jun. 5, 1990

[54] BRAKE ACTUATOR FOR HYDRAULIC MOTORS

[75] Inventor: Jeffrey D. Metcalf, Albion, Ill.

[73] Assignee: Sundstrand Corporation, Rockford, Ill.

[21] Appl. No.: 252,587

[22] Filed: Oct. 3, 1988

[51] Int. Cl.[5] ..... F16D 31/00

[52] U.S. Cl. ..... 60/442; 60/435

[58] Field of Search ..... 60/435, 442

[56] References Cited

U.S. PATENT DOCUMENTS

| | | | |
|---|---|---|---|
| 3,557,913 | 1/1971 | Russler . | |
| 3,661,230 | 5/1972 | Burnett . | |
| 3,770,085 | 11/1973 | Cottingham . | |
| 3,771,627 | 11/1973 | Caldwell et al. . | |
| 3,831,718 | 8/1974 | Muller et al. . | |
| 3,863,038 | 1/1975 | Kreitner et al. . | |
| 4,014,414 | 3/1977 | Yamamoto et al. . | |
| 4,023,654 | 5/1977 | Winzeler . | |
| 4,024,936 | 5/1977 | Crabb . | |
| 4,057,297 | 11/1977 | Beck et al. . | |
| 4,077,500 | 3/1978 | Hickman, Sr. et al. . | |
| 4,078,637 | 3/1978 | Hanks . | |
| 4,213,244 | 7/1980 | Bell et al. . | |
| 4,263,991 | 4/1981 | Morgan et al. . | |
| 4,279,330 | 7/1981 | Pottorff et al. . | |
| 4,351,422 | 9/1982 | Chauve . | |
| 4,458,486 | 7/1984 | Baker | 60/437 |
| 4,470,487 | 9/1984 | Blatt . | |
| 4,560,034 | 12/1985 | Windish et al. . | |
| 4,607,703 | 8/1986 | Paisley . | |
| 4,609,076 | 9/1986 | Collins et al. . | |
| 4,615,418 | 10/1986 | Atwell . | |

*Primary Examiner*—Carl D. Price

*Attorney, Agent, or Firm*—Wood, Phillips, Mason, Recktenwald & Vansanten

[57] ABSTRACT

A brake actuator for use in combination with a hydraulic motor which includes a port structure. The port structure defines an interface with a motor block of the hydraulic motor and includes ports for supplying fluid to the motor. A brake is operatively associated with the hydraulic motor. A hydraulically operated piston is disposed substantially within the confines of the port structure for actuating the brake.

8 Claims, 2 Drawing Sheets

BRAKE ACTUATOR FOR HYDRAULIC MOTORS

FIELD OF THE INVENTION

This invention generally relates to brake actuating mechanisms and, more particularly, to a brake actuator particularly adapted for use in combination with a hydraulic motor.

BACKGROUND OF THE INVENTION

Brake actuating mechanisms are well known wherein fluid pressure may be applied to a piston to move the piston in conjunction with a spring force operatively associated between the piston and a brake. Conventionally, the brakes are released upon application of fluid pressure and are applied by the spring means associated with the brakes upon the release or loss of the fluid pressure. Such brake actuating mechanisms or systems have been used in a wide variety of applications from vehicle parking brakes to aerospace applications.

One of the problems in aerospace applications is that such brake actuators often are used with hydraulic motors, such as a wobbler-plate type hydraulic motor. These motors usually have a rather large, massive port structure, often called a "port plate", which have fluid ports to supply fluid to the hydraulic motor, such as to the pistons of a wobbler-plate type motor. The port structure is rather massive in order to avoid deflections at the interface with the motor block. The actuator piston often must be located outside or about the port structure in order to operate effectively with the spring means, brake disks and other components of the brake actuating mechanism. This creates a problem particularly in aerospace applications where space limitations are critical. In other words, envelope constraints often restrict the space available for packaging a required brake actuator mechanism.

A somewhat related problem with such applications is that all dynamic sealing locations leading to atmosphere are required to have double seals which further complicates the envelope problem.

Still another problem with brake actuators of the character described concerns hydraulic pressure spikes. In other words, where the application of fluid pressure is effective to allow the spring to apply a braking force, pressure spikes can cause problems in momentarily releasing and applying the braking forces.

This invention is directed to solving the above problems in a brake actuator for use in combination with a hydraulic motor.

SUMMARY OF THE INVENTION

An object, therefore, of the invention is to provide a new and improved brake actuating mechanism and, particularly, to a brake actuator which is readily applicable for use in combination with a hydraulic motor.

In the exemplary embodiment of the invention, the hydraulic motor includes a port structure defining an interface with a motor block of the hydraulic motor, the port structure including port means for supplying fluid to the motor. Generally, brake means are operatively associated with the hydraulic motor. Piston means are provided for actuating the brake means, and the piston means is located within the port structure, i.e. within the existing envelope of the port structure. This greatly reduces the overall packaging size of the assembly whenever a brake actuator must be used in conjunction with a hydraulic motor.

More particularly, as disclosed herein, the hydraulic motor includes a shaft extending therefrom, through the port structure and to the brake means. The piston means surrounds the shaft, and the port structure, in part, surrounds at least a portion of the piston means. Cylinder means are defined between the port structure and the piston means. Fluid passage means extend through the port structure to the cylinder means.

The invention contemplates the cylinder means to include a first chamber on one side of the piston means and a second chamber on an opposite side of the piston means, with first and second passages, respectively, through the port structure to the chambers. One of the chambers is connected to a constant pressure supply. The other chamber is selectively connectable, as by a valve, either to the pressure supply or to a return duct. Therefore, when both chambers are connected to the pressure supply, the pressure is equal on both sides of the piston, and any pressure spikes in the hydraulic system are ineffective. When the supply pressure is removed or lost, the spring applies the brake.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
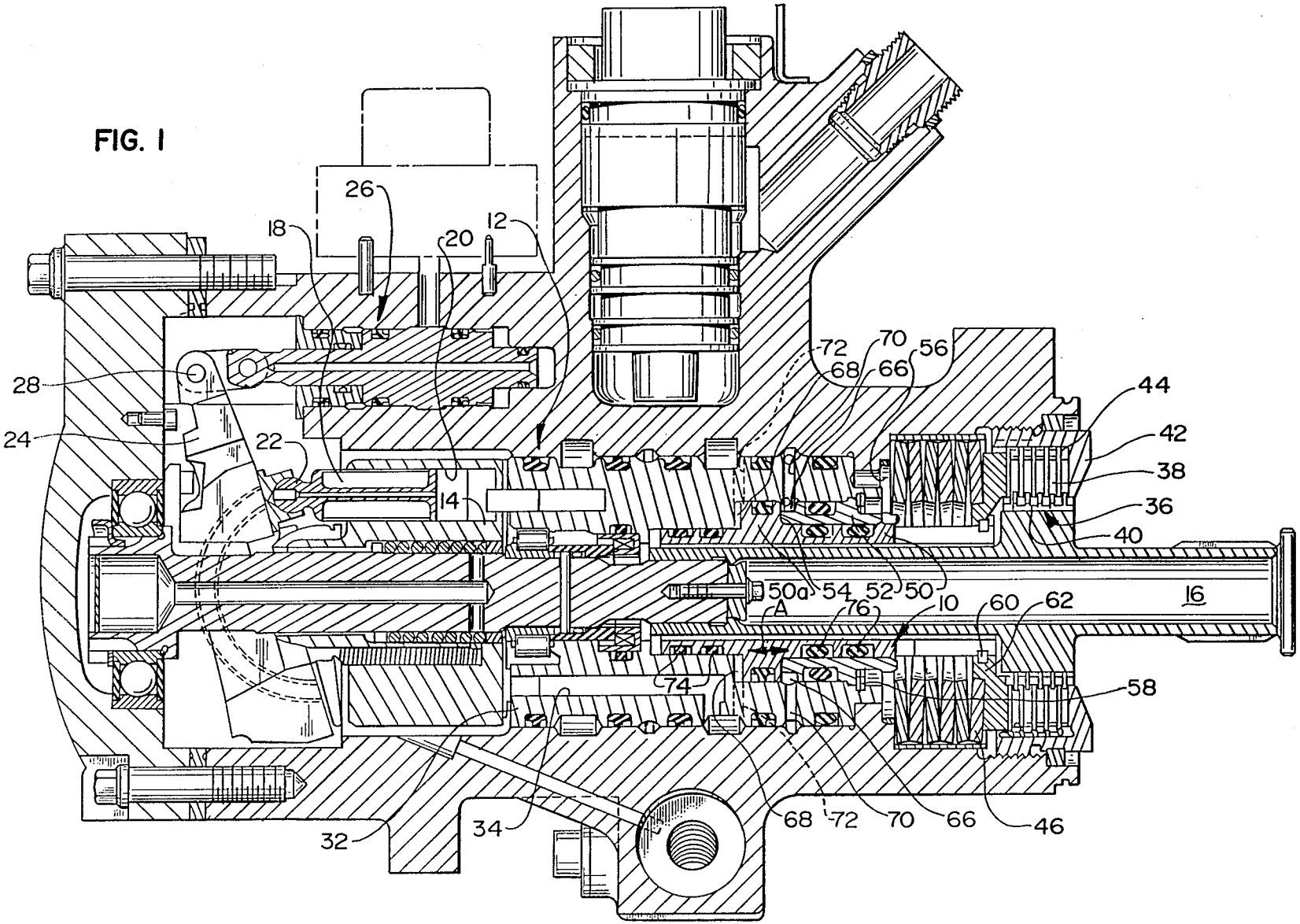
FIG. 1 is an axial section through a hydraulic motor in combination with a brake actuator according to the invention.

Referring to the drawings in greater detail, and first to FIG. 1, the invention is directed to a brake actuator mechanism, generally designated 10, for use in conjunction with a hydraulic motor, generally designated 12.

Hydraulic motor 12 is of the wobbler-plate type and is of generally conventional configuration and construction. More particularly, a motor block 14 is splined for rotation with shaft means 16. A plurality of pistons 18 are disposed reciprocally within cylinders 20 of motor block 14. Exposed ends of the pistons are journaled, as at 22, to a wobbler plate 24. The hydraulic motor shown is of the variable displacement type in that a piston and cylinder device, generally designated 26, is connected to wobbler plate 24, as at 28, to adjust the angle of the wobbler plate and, therefore, the displacement of the motor pistons. All of this is generally conventional and well known in the art of hydraulic motors.

In addition, a port structure 30 abuts against the back of engine block 14 at a generally planar interface 32. The port structure often is called a "port plate" even though it is rather massive in relative size. The port plate not only supplies fluid to motor cylinders 20, as by means of ports 34, but the mass of the port plate avoids deflections of the motor at interface 32.

In many applications, such as aerospace applications, brake mechanisms are employed to brake the motor, i.e. stop rotation of shaft 16, in the event of loss of hydraulic pressure in the system. To this end, a disk-type brake, generally designated 36, is operatively associated with shaft 16. Brake 36 is of conventional construction and includes a plurality of interleaved disks 38 which are alternately splined to shaft 16, as at 40, and to a brake mount 42, as at 44. Spring means 46 are located in abutment with brake mount 42 to apply the brake and stop rotation of shaft 16 when the spring forces are rendered effective to clamp interleaved disks 38.

The invention contemplates locating a brake actuating piston 50 substantially within the envelope already provided by port plate 30. The piston surrounds shaft 16 and is reciprocally movable relative thereto in the direction of double-headed arrow "A", as well as being movable in that axial direction relative to brake 36 and spring 46. A slide member 52 surrounds piston 50 and abuts the piston at 54. A flange member 56 surrounds slide member 52 and abuts the slide member at 58. It can be seen that flange member 56 abuts the end of spring 46 opposite brake mount 42. In addition, a ring member 60 surrounds piston 50 and abuts a flange 62 of brake mount 42.

From the foregoing, it can be understood that if brake actuator piston 50 (along with slide member 52, flange member 56 and ring member 60) moves to the right as viewed in FIG. 1, spring 46 is rendered effective to apply pressure to brake mount 42 and thereby clamp brake disks 38 to apply the brake to shaft 16 and stop the shaft. If the piston and the above-described related components move to the left as viewed in FIG. 1, the spring pressure is relieved and the brake is released.

Movement of brake actuator piston 50 and its related components is effected hydraulically by cylinder means operatively associated between the piston and port plate 30. More particularly, a first fluid chamber 66 is provided on one side of a piston flange **50*a*, the chamber being defined by a space between the piston flange, port plate 30 and slide member 52. A second chamber 68 is defined on the opposite side of piston flange 50*a*, between the flange and port plate 30. A first fluid passage 70 leads radially through the port plate to first chamber 66 and a second fluid passage 72 extends radially through the port plate to second chamber 68. Therefore, it can be understood that movement of piston 50 in the direction of double-headed arrow "A" is effected by selective application of pressure (or loss thereof) to chambers 66,68 through passages 70,72 as described hereinafter. It can be seen that by positioning the piston within the confines of port plate 30, ample room is provided for double seals 74 and 76** completely within the envelope of the existing port plate.

Figure 2:
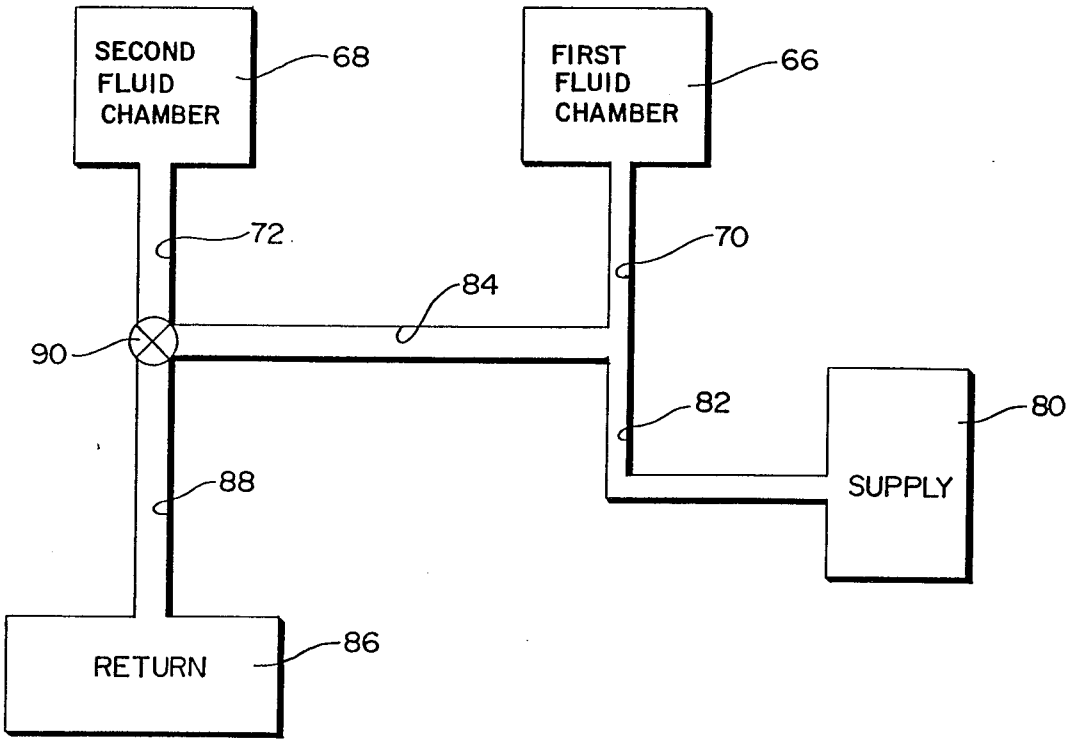
FIG. 2 is a schematic illustration of the hydraulic circuit to the brake actuator piston.

Referring to FIG. 2 in conjunction with FIG. 1, a schematic diagram is shown to illustrate the hydraulic control circuit to cylinder chambers 66 and 68 through passages 70 and 72, respectively. More particularly, passage 70 from chamber 66 communicates with or is connected to a pressure supply 80 by an appropriate supply duct 82. In other words, chamber 66 constantly communicates with the pressure supply. Chamber 68, through passage 72, communicates with or is connected to both the pressure supply 80, by means of a duct 84, and to a return 86, through a duct 88. Therefore, chamber 68 also may be maintained in constant communication with the pressure supply. However, a control valve 90 is appropriately disposed within the hydraulic circuit, for instance at the juncture of ducts 84 and 88 in the illustrated diagram, for selectively connecting chamber 68 either to the pressure supply or to return.

From the above description of the hydraulic circuit of FIG. 2, it can be understood that when valve 90 is positioned to communicate chamber 68 with pressure supply 80, the supply pressure exists on both sides of the piston (i.e. on both sides of piston flange **50*a*, FIG. 1) to balance any hydraulic forces on the piston. Therefore, spring 46 is rendered effective to selectively apply brake 36. Furthermore, with the balancing of pressures, any hydraulic spikes occurring in the hydraulic circuit will be totally ineffective. Of course, should there be a complete loss of hydraulic pressure in the system, spring 46 will be rendered effective to apply the brake. In order to release the brake, valve 90 is actuated to close chamber 68 to pressure supply 80 and to communicate the chamber to return 86, through duct 88. In other words, the valve would release the control pressure. In this condition, and referring back to FIG. 1 and the description thereof, piston 50, slide member 52, flange member 56 and ring member 60 all will move to the left as viewed in the drawing, due to the supply pressure still being applied through passage 70 to cylinder chamber 66**, to relieve the spring and release the brake.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A brake actuator in combination with a hydraulic motor, comprising:

a port structure defining an interface with a motor block of the hydraulic motor and including portion means for supplying fluid to the motor;

brake means operatively associated with the hydraulic motor;

piston means for actuating the brake means, the piston means being located within the port structure;

cylinder means defined between the port structure and the piston means, the cylinder means including a first chamber on one side of the piston means and a second chamber on an opposite side of the piston means;

a first passage through the port structure to the first chamber; and a second passage through the port structure to the second chamber.

2. The combination of claim 1, including means communicating said first passage to a pressure supply, means communicating the second passage to the pressure supply and to a return duct, and valve means in the second passage for selectively connecting the second passage to either the pressure supply or the return duct.

3. The combination of claim 2, including means operatively associating the piston with the brake means whereby the brake is actuated when said first and second passages both are connected to the pressure supply.

4. The combination of claim 3, including spring means operatively associated between the piston means and the brake means for applying the brake means when the pressure supply is connected to the first and second passages.

5. A brake actuator in combination with a hydraulic motor, comprising:

a port structure defining an interface with a motor block of the hydraulic motor and including port means for supplying fluid to the motor;

brake means operatively associated with the hydraulic motor;

shaft means between the hydraulic motor and the brake means, the shaft means extending through the port structure;

piston means for actuating the brake means, the piston means being located within the port structure;

cylinder means defined between the port structure and the piston means, said cylinder means including a first chamber on one side of the piston means and a second chamber on an opposite side of the piston means; and a first passage through the port structure to the first chamber and a second passage through the port structure to the second chamber.

6. The combination of claim 5, including means communicating said first passage to a pressure supply, means communicating the second passage to the pressure supply and to a return duct, and valve means in the second passage for selectively connecting the second passage to either the pressure supply or the return duct.

7. The combination of claim 6, including means operatively associating the piston with the brake means whereby the brake is actuated when said first and second passages both are connected to the pressure supply.

8.. The combination of claim 7, including spring means operatively associated between the piston means and the brake means for applying the brake means when the pressure supply is connected to the first and second passages.

* * * * *